US005301836A

United States Patent [19]

Luu

[11] Patent Number: 5,301,836

[45] Date of Patent: Apr. 12, 1994

[54] LIQUID DISPENSER HAVING MOVABLE HEAD AS PUMP ACTUATOR

[76] Inventor: Tom Tho Truong Luu, 232 Beegum Way, San Jose, Calif. 95123

[21] Appl. No.: 45,888

[22] Filed: Apr. 14, 1993

[51] Int. Cl.[5] ..... B67D 5/00

[52] U.S. Cl. ..... 222/78; 222/321

[58] Field of Search ..... 222/78, 182, 183, 321, 222/214; 239/211, 289

[56] References Cited

U.S. PATENT DOCUMENTS

| | | | |
|---|---|---|---|
| 2,771,219 | 11/1956 | Dewey | 222/78 X |
| 3,105,612 | 10/1963 | Krasnoff et al. | 222/78 |
| 3,359,917 | 12/1967 | Cooprider | 222/321 X |
| 4,182,465 | 1/1980 | Bennett | 222/214 X |
| 4,193,517 | 3/1980 | Fetty et al. | 222/78 |
| 4,570,829 | 2/1986 | Allen | 222/78 X |
| 5,071,387 | 12/1991 | Pottick | 222/78 X |

*Primary Examiner*—Kevin P. Shaver
*Attorney, Agent, or Firm*—Michael I. Kroll

[57] ABSTRACT

A improved liquid dispenser is provided which consists of a container for holding liquid therein. A mechanism extending into and upwardly from the container is for dispensing the liquid out of the container, so that the liquid can be used in convenient amounts. A cover engages with the liquid dispensing mechanism extending upwardly from the container to allow the liquid to exit from the cover.

6 Claims, 4 Drawing Sheets

LIQUID DISPENSER HAVING MOVABLE HEAD AS PUMP ACTUATOR

BACKGROUND OF THE INVENTION

1. Field of the Invention

The instant invention relates generally to receptacles and more specifically it relates to an improved liquid dispenser.

2. Description of the Prior Art

Numerous receptacles have been provided in prior art that are adapted to hold and carry various types of materials, so that the materials can be utilized therefrom. While these units may be suitable for the particular purpose to which they address, they would not be as suitable for the purposes of the present invention as heretofore described.

SUMMARY OF THE INVENTION

A primary object of the present invention is to provide an improved liquid dispenser that will overcome the shortcomings of the prior art devices.

Another object is to provide an improved liquid dispenser that consists of a container for holding liquid, an apparatus extending upwardly from the container for dispensing the liquid and a cover which fits over the apparatus to allow the liquid to exit therefrom.

An additional object is to provide an improved liquid dispenser in which the container is in the shape of an animal body, while the cover is in the shape of a matching animal head, so as to make the dispenser pleasing to the eye.

A further object is to provide an improved liquid dispenser that is simple and easy to use.

A still further object is to provide an improved liquid dispenser that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
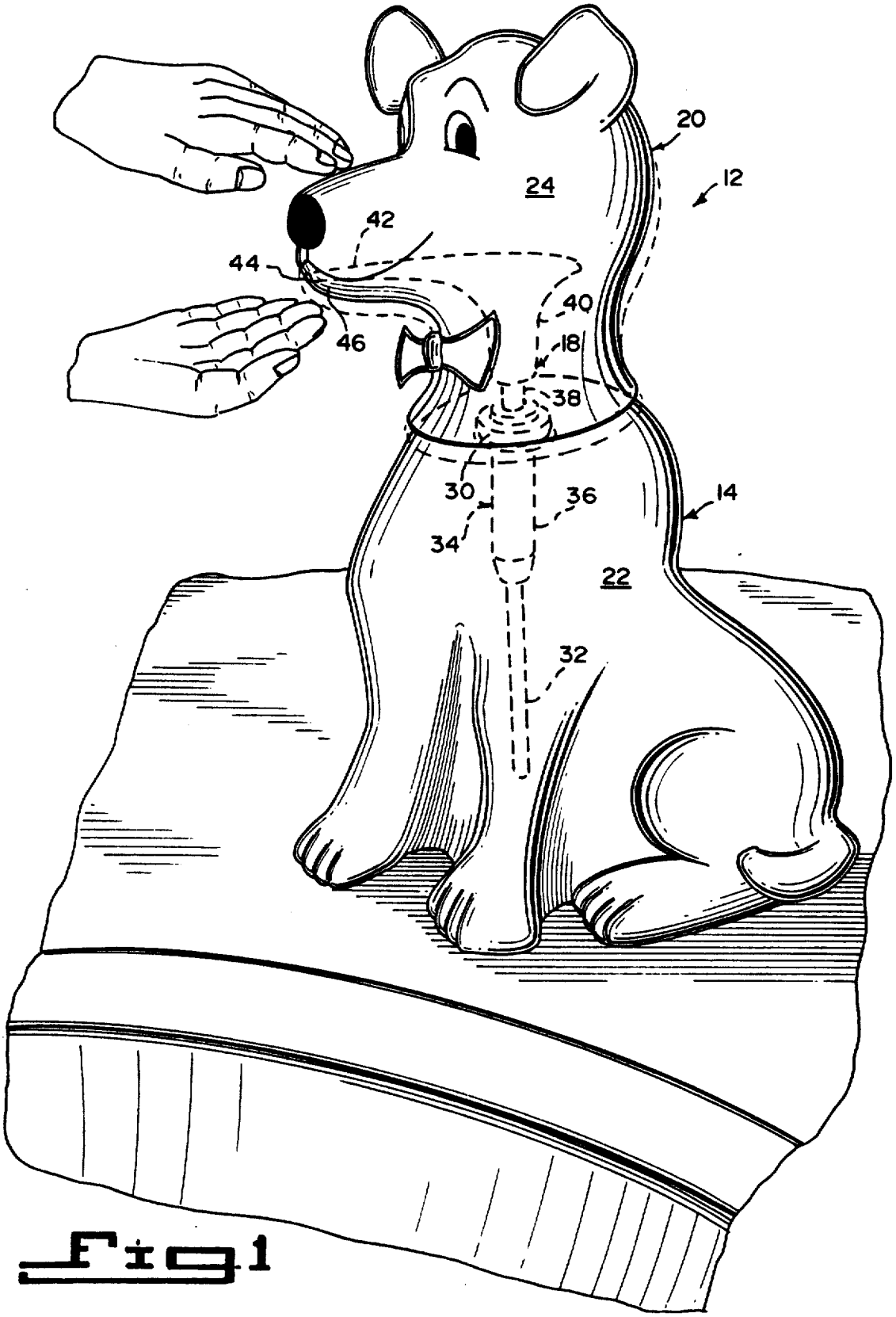
FIG. 1 is a perspective view of a first embodiment of the instant invention.

Turning now descriptively to the drawings, in which similar reference characters denote similar elements throughout the several views, the Figures illustrate an improved liquid dispenser 12 which consists of a container 14 for holding liquid 16 therein. A mechanism 18 extending into and upwardly from the container 14 is for dispensing the liquid 16 out of the container 14, so that the liquid 16 can be used in convenient amounts. A cover 20 engages with the liquid dispensing mechanism 18 extending upwardly from the container 14 to allow the liquid 16 to exit from the cover 20.

The container 14 is in the shape of an animal body 22, while the cover 20 is in the shape of an animal head 24. The container 14 is fabricated out of a plastic material 26 and the cover 20 is also fabricated out of a plastic material 26.

The container 20 contains an externally threaded neck 28. The liquid dispensing mechanism 18 contains an internally threaded cap 30, to engage with the externally threaded neck 28 on the container 20. The liquid dispensing mechanism further includes a dip tube 32 below the internally threaded cap 30, which extends into the liquid 16 within the container 14. A device 34 is for extracting some of the liquid 16 up through the dip tube 32 and out of the cover 20.

Figure 5:
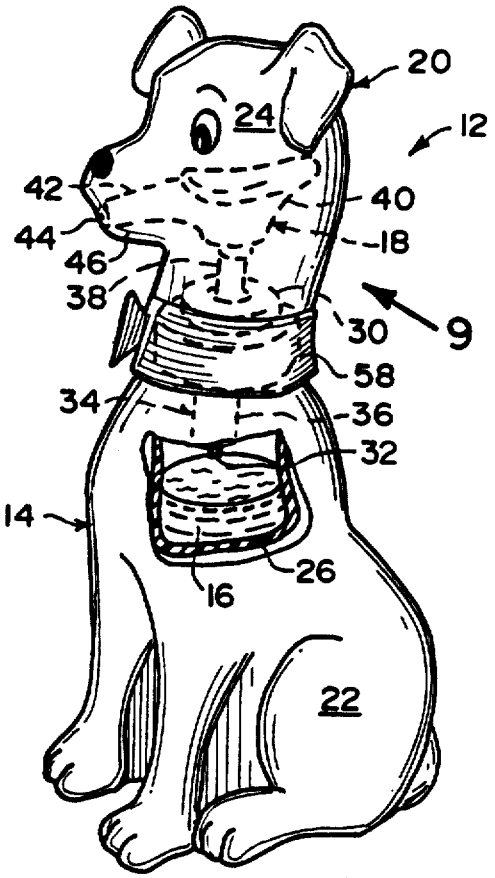
FIG. 5 is a perspective view of a third embodiment of the instant invention with part broken away.
Figure 7:
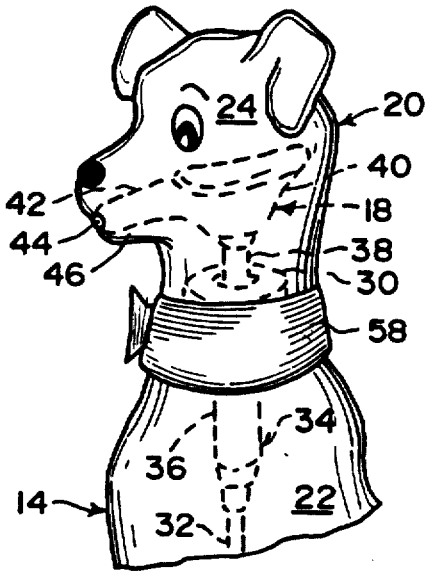
FIG. 7 is a perspective view of the third embodiment with the lower portion of the container removed.
Figure 9:
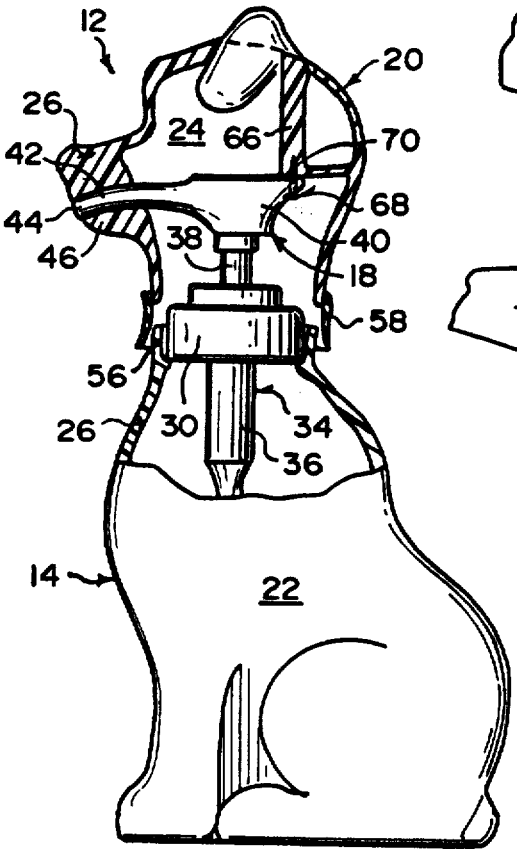
FIG. 9 is a side view taken in direction of arrow 9 in FIG. 5, with the cover, collar and upper portion of the container in section.

The liquid extracting device 34, as shown in the first embodiment in FIG. 1 and the third embodiment in FIGS. 5, 7, 9 and consists of an accumulator 36 between the internally threaded cap 30 and the dip tube 32. A piston 38 extends upwardly from the accumulator 36 through the internally threaded cap 30. A saddle head 40 having a spout 42 is also provided. The saddle head 40 is fluidly connected to the position 38 and is mounted within the cover 20 with the spout 42 extending through the cover 20. When the cover is depressed downwardly, some of the liquid 16 will exit through the spout 42. A distal free end 44 of the spout 42 is located on the cover 20 approximate at a mouth 46 of the animal shaped head 24.

Figure 2:
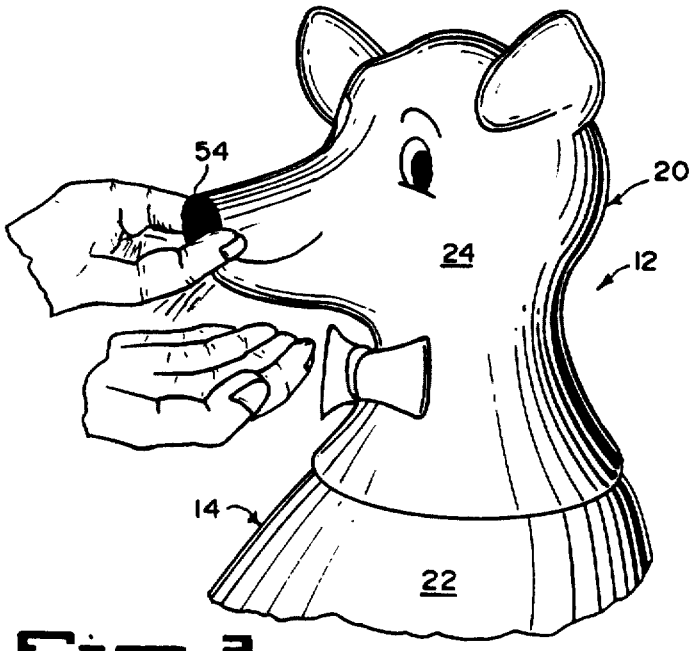
FIG. 2 is a perspective view of a second embodiment of the instant invention with parts broken away.
Figure 3:
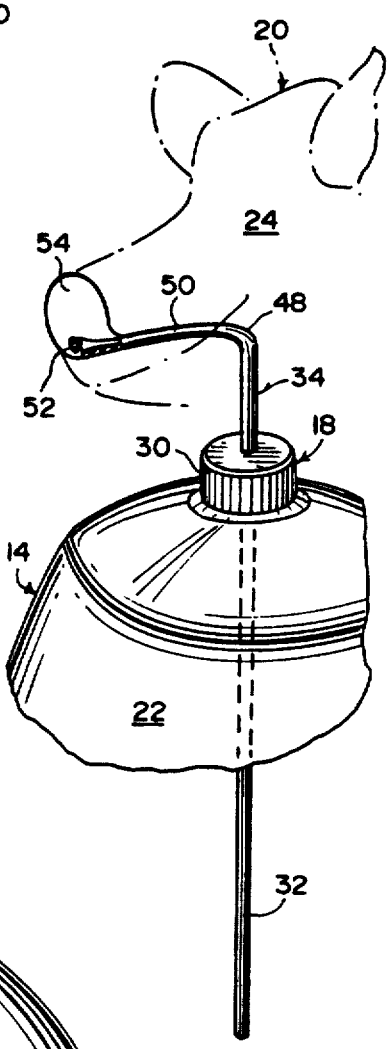
FIG. 3 is a perspective view of the second embodiment with parts broken away and in phantom, showing the liquid dispensing mechanism therein.
Figure 4:
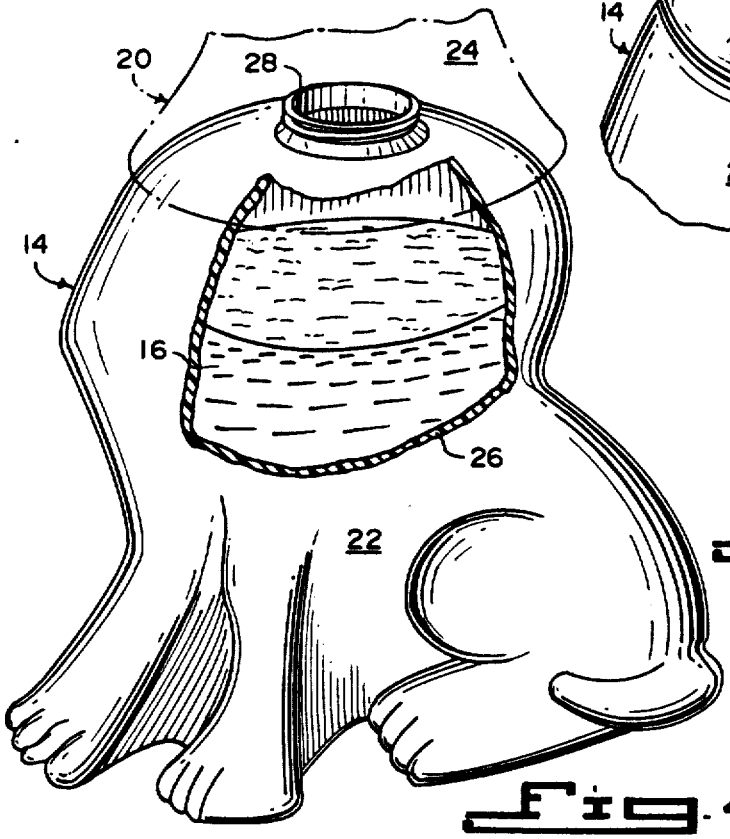
FIG. 4 is a perspective view of the container with parts broken away and the cover in phantom for the first and second embodiments.

The liquid extracting device 34, shown in the second embodiment in FIG. 3, includes a squeeze tube 48 extending upwardly from the internally threaded cap 30 and is fluidly connected to the dip tube 32. The squeeze tube 48 has a spout 50 extending through the cover 20. When the cover 20 is compressed together at the spout 50 as shown in FIG. 2, some of the liquid 16 will exit through the spout 50. A distal free end 52 of the spout 50 is located on the cover 20 approximate at a nose 54 of the animal shaped head 24.

Figure 6:
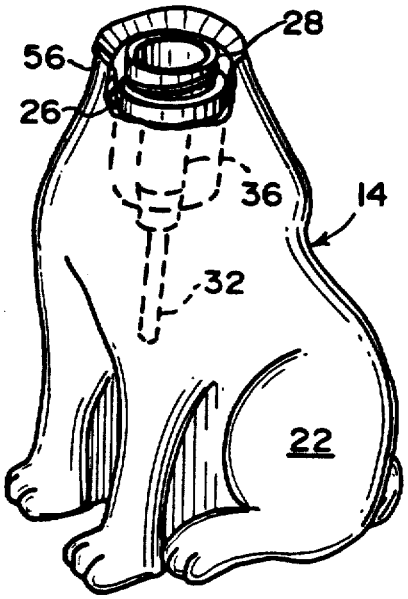
FIG. 6 is a perspective view of the container with parts broken away for the third embodiment.
Figure 8:
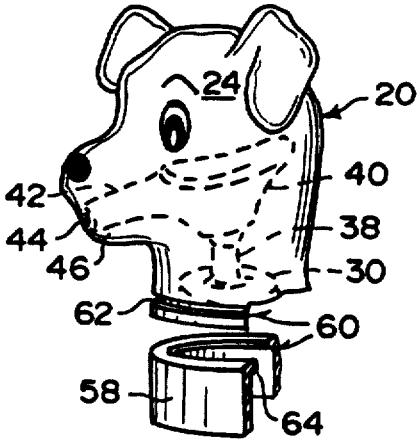
FIG. 8 is a partial exploded perspective view showing the cover and collar of the third embodiment broken away.

In the third embodiment as best seen in FIG. 6, the container 14 includes an annular sleeve 56, formed about the externally threaded neck 28, so as to form a recess thereabout. The third embodiment as best seen in FIG. 8, further includes a flexible collar 58 for the cover 20. A structure 60 is for attaching the flexible collar 58 about a lower end of the cover 20. This forms a seal about the recessed externally threaded neck 28 of the container 14 and the internally threaded cap 30 of the liquid dispensing mechanism 18, when the cover 20 is depressed downwardly.

The flexible collar attaching structure 60 consists of the cover 20 having an annular groove 62 about its lower end. The flexible collar 58 has an annular tongue 64 formed about an upper end, so that the annular tongue 64 can engage with the annular groove 62.

Figure 10:
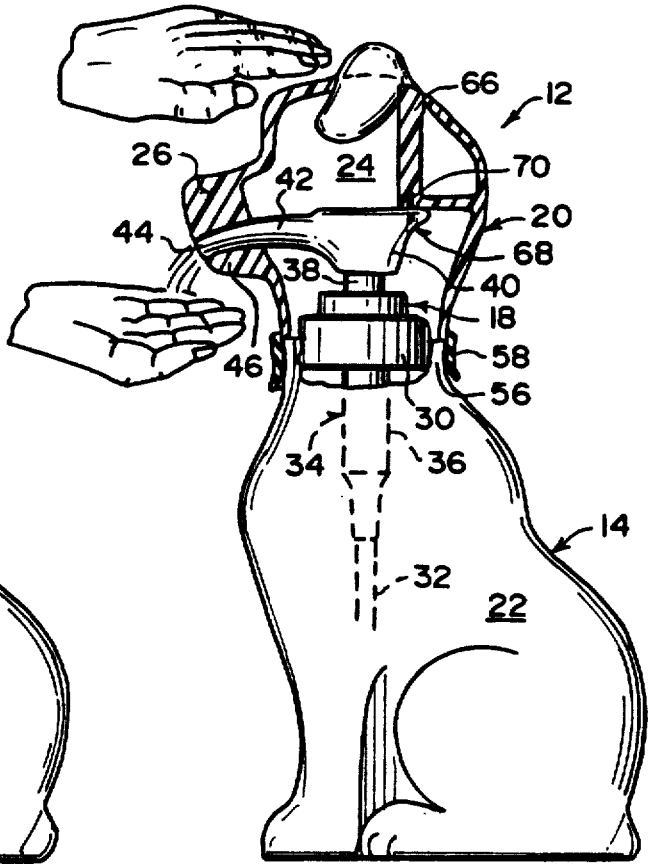
FIG. 10 is a side view similar to FIG. 9, showing the cover depressed and the dispensing mechanism in operation.
Figure 11:
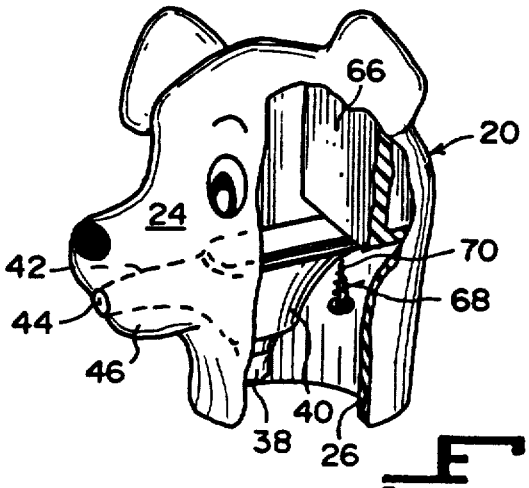
FIG. 11 is a perspective view of the cover of the third embodiment with parts broken away showing how the saddle head of the dispensing mechanism is attached thereto.

As shown in FIGS. 9, 10 and 11, the saddle head 40 in the third embodiment is internally mounted to the cover 20. An L-shaped frame 66 is formed within the cover 20, so that a corner of the L-shaped frame 66 will contact an upper rear portion of the saddle head 40 opposite fro the spout 42. A fastener 68 secures the upper rear portion of the saddle head 40 to the cover of the L-shaped frame 66. The fastener 68 is a mounting screw 70, which extends through the upper rear portion of the saddle head 40 and into the corner of the L-shaped frame 66.

LIST OF REFERENCE NUMBERS 12 improved liquid dispenser
14 container
16 liquid
18 liquid dispensing mechanism
20 cover
22 animal shaped body for 14
24 animal shaped head for 20
26 plastic material for 14 and 20
28 externally threaded neck on 20
30 internally threaded cap of 18
32 dip tube
34 liquid extracting device
36 accumulator
38 piston
40 saddle head
42 spout on 40
44 distal free end of 42
46 mouth of 24
48 squeeze tube
50 spout on 48
52 distal free end of 50
54 nose of 24
56 annular sleeve on 14
58 flexible collar
60 attaching structure
62 annular groove on 20
64 annular tongue on 58
66 L-shaped frame in 20
68 fastener
70 mounting screw for 68

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A liquid dispenser which comprises:
   a. a plastic container in the shape of an animal body for holding liquid therein, said container having an externally threaded neck and an annular sleeve disposed about said externally threaded neck so as to form a recess therebetween;
   b. means extending into and upwardly from said container for dispensing the liquid out of said container, said dispensing means comprising an internally threaded cap for engaging the externally threaded neck of the container, a dip tube below said internally threaded cap which extends into the liquid within the container, an accumulator between said internally threaded cap and said dip tube, a reciprocating piston disposed within and extending upwardly from said accumulator and through said internally threaded cap, and a saddle head fluidly connected to said piston and having a spout; and
   c. a plastic cover in the shape of an animal head disposed over and engaging with said saddle head of said liquid dispensing means so that depressing said cover downwardly will operate said liquid dispensing means, and said cover having an opening approximate a mouth of said animal shaped head through which said spout of said saddle head extends.

2. An improved liquid dispenser as recited in claim 1, further including:
   a) a flexible collar for said cover; and
   b) means for attaching said flexible collar about a lower end of said cover, so as to form a seal about said recessed externally threaded neck of said container and said internally threaded cap of said liquid dispensing means, when said cover is depressed downwardly.

3. An improved liquid dispenser as recited in claim 2, wherein said flexible collar attaching means includes:
   a) said cover having an annular groove about its lower end; and
   b) said flexible collar having an annular tongue formed about an upper end, so that said annular tongue can engage with said annular groove.

4. An improved liquid dispenser as recited in claim 3, further including means for mounting internally said saddle head to said cover.

5. An improved liquid dispenser as recited in claim 4, wherein said internal mounting means includes:
   a) an L-shaped frame formed within said cover, so that a corner of said L-shaped frame will contact an upper rear portion of said saddle head opposite from said spout; and
   b) a fastener to secure said upper rear portion of said saddle head to said corner of said L-shaped frame.

6. An improved liquid dispenser as recited in claim 5, wherein said fastener is a mounting screw, which extends through said upper rear portion of said saddle head and into said corner of said L-shaped frame.

* * * * *